US006513438B1

(12) United States Patent
Fegg et al.

(10) Patent No.: US 6,513,438 B1
(45) Date of Patent: Feb. 4, 2003

(54) METHOD FOR OFFERING A PHANTOM TARGET, AND DECOY

(75) Inventors: Martin Fegg, Bischofswiesen (DE); Heinz Bannasch, Schoenau (DE)

(73) Assignee: Buck Neue Technologien GmbH, Neuenburg (DE)

( * ) Notice: Subject to any disclaimer, the term of this patent is extended or adjusted under 35 U.S.C. 154(b) by 69 days.

(21) Appl. No.: 09/697,160

(22) Filed: Oct. 27, 2000

(30) Foreign Application Priority Data

Oct. 27, 1999 (DE) ..... 199 51 767

(51) Int. Cl.[7] ..... F42B 4/26; H01Q 17/00
(52) U.S. Cl. ..... 102/336; 342/12; 102/505
(58) Field of Search ..... 102/336, 505; 342/12

(56) References Cited

U.S. PATENT DOCUMENTS

| | | | | | |
|---|---|---|---|---|---|
| 3,841,219 | A | * | 10/1974 | Schillreff | 102/505 |
| 4,130,059 | A | * | 12/1978 | Block et al. | 102/34.4 |
| 4,286,498 | A | * | 9/1981 | Block et al. | 86/1 R |
| 4,446,793 | A | * | 5/1984 | Gibbs | 102/505 |
| 4,549,489 | A | * | 10/1985 | Billard et al. | 102/505 |
| 4,621,579 | A | | 11/1986 | Badura et al. | 102/334 |
| 4,624,186 | A | * | 11/1986 | Widera et al. | 102/336 |
| 4,726,295 | A | * | 2/1988 | Embury, Jr. et al. | 102/505 X |
| 4,838,167 | A | | 6/1989 | Prahauser et al. | 102/334 |
| 5,049,883 | A | * | 9/1991 | Woodward | 342/12 |
| 5,317,163 | A | * | 5/1994 | Obkircher | 102/334 X |
| 5,397,236 | A | | 3/1995 | Fegg et al. | 434/11 |
| 5,635,666 | A | | 6/1997 | Bannasch et al. | 102/334 |
| 5,654,522 | A | * | 8/1997 | Endicott, Jr. et al. | 102/336 X |
| 5,661,257 | A | * | 8/1997 | Nielson et al. | 102/336 X |
| 5,835,051 | A | | 11/1998 | Bannasch et al. | 342/12 |

FOREIGN PATENT DOCUMENTS

| | | |
|---|---|---|
| DE | 34 21 692 C2 | 12/1985 |
| DE | 35 15 166 A1 | 10/1986 |
| DE | 23 59 758 C1 | 7/1988 |
| DE | 38 35 887 A1 | 5/1990 |
| DE | 42 38 038 C1 | 6/1994 |
| DE | 43 27 976 C1 | 1/1995 |
| DE | 196 17 701 A1 | 11/1997 |
| WO | WO 90/04750 | 5/1990 |

OTHER PUBLICATIONS

Dual Mode Giant, Buck Technologies, Heinz Bannasch, Feb. 2000, 1 page.
Wallop Expands Its Electronic–Warfare Activities, International Defense Review, Mark Hewish, Dec. 1982, 4 Pages.

* cited by examiner

*Primary Examiner*—Peter A. Nelson
(74) *Attorney, Agent, or Firm*—Sughrue Mion, PLLC

(57) ABSTRACT

A method and associated decoy for offering a phantom target for protecting land, air or water vehicles or the like as a defense against missiles possessing a target seeking head operating in the infrared (IR) or radar (RF) range, or a target seeking head simultaneously or serially operating in both wavelength ranges. An effective mass emitting radiation in the IR range (IR effective mass) based on flares and a mass backscattering RF radiation (RF effective mass) based on dipoles are simultaneously made to take effect in an appropriate position as a phantom target. A ratio of dipole mass to flare mass of approx. 3.4:1 to approx. 6:1 is employed; and flares presenting a descent rate approx. 0.5 to 1.5 m/s higher than that of the dipoles are used.

43 Claims, 3 Drawing Sheets

METHOD FOR OFFERING A PHANTOM TARGET, AND DECOY

The following disclosure is based on German Application No. 19951767.3, filed on Oct. 27, 1999, the disclosure of which is incorporated into this application by reference.

FIELD OF THE INVENTION

The present invention relates to a method for offering a phantom target for the protection of land, air or water vehicles or the like as a defense against missiles possessing a target seeking head operating in the infrared (IR) or radar (RF) range, or a target seeking head simultaneously or serially operating in both wavelength ranges. The invention furthermore relates to a combined RADAR/IR decoy.

BACKGROUND AND OBJECTS OF THE INVENTION

A threat owing to modern, autonomously operating missiles is clearly increasing, inasmuch as even missiles having leading-edge target seeking systems are becoming widespread as a result of the collapse of the former superpower, the Soviet Union, and of liberal export regulations particularly by Asian countries. The target seeking systems of such missiles operate mainly in the radar (RF) and infrared (IR) ranges. Herein both the radar backscattering behavior and the emission of specific infrared radiation from targets, such as ships, aircraft, tanks, etc. are made use of for target location and target tracking. In leading-edge missiles, the development clearly presents a trend towards multispectral target seeking systems simultaneously or serially operating in the radar and infrared ranges in order to be able to perform an improved false-target discrimination. For the purpose of false-target discrimination, multispectral IR target seeking heads operate with two detectors that are sensitive in the short-wave and long-wave infrared range. So-called dual mode target seeking heads operate in the radar and infrared ranges. Missiles possessing such target seeking heads are radar controlled in the approach and seek phases and switch over to, or add on, an IR seeking head in the tracking phase.

One target criterion of dual mode target seeking heads is the so-called co-location of RF backscattering and of the IR center of radiation. Comparison of co-ordinates being possible, discrimination of false targets (e.g. clutter, such as older decoy types) is improved. The optimised co-location of RF and IR efficiency is therefore an indispensable prerequisite for a dual mode decoy in order to enable effective deception of modern dual mode target seeking heads, i.e., their diversion from a target to be protected to a phantom target. Herein merely the smallest possible resolution cell of the target seeking head (RF and IR) is of relevance for co-location.

A first successul method for the diversion of weapons possessing dual mode target seeking heads approaching the object to be protected is described in German patent specification DE 196 17 701, which corresponds to issued U.S. Pat. No. 5,835,051.

In this prior art, a mass which emits radiation in the IR range (IR effective mass) and a mass which backscatters RF radiation (RF effective mass) are simultaneously made to take effect in the appropriate position as a phantom target.

As an RF effective mass in the prior art of DE 196 17 701, rolled-up radar chaff that comprises dipoles of aluminum or silver coated glass fiber filaments having a thickness of approx. 10 $\mu$m to 100 $\mu$m are used and employed in a number of more than approx. $10^6$ dipoles/kg.

IR flares, known, e.g., from German Patent DE-PS 43 27 976 and its corresponding U.S. Pat. No. 5,635,666 and emitting a medium-wave radiation component (MWIR flares), are preferably employed as the IR effective mass.

In accordance with the prior art of DE 196 17 701, the effective masses are placed in a projectile having a caliber, for example, in the range of about 10 to 155 mm.

In accordance with DE 196 17 701, the effective masses—including activating and distributing means—are jointly ejected from a projectile shell and successively activated and distributed during the in-flight phase of the projectile by means of a deployment element.

Thus it is achieved that the effective masses are deployed without any screening so that no excessive pressure acts on the effective masses during their distribution. Accordingly, the distribution of the IR effective mass and in particular the distribution of the RF effective mass may already be improved considerably. Activation of the IR effective mass is moreover clearly improved, whereby the effectivity of the IR effective mass in terms of radiation intensity per volume unit as well as in terms of radiating surface is increased in comparison with methods not providing for ejection of the effective masses.

In accordance with the prior art of DE 196 17 701, it is generally provided to use a propellant charge for ejection of the deployment element, which propellant charge is ignited by an ignition delay means which is ignited by combustion of an ejection propellant charge for the projectile.

Preferably the ejection propellant charge for the deployment element is ignited by means of a pyrotechnical ignition delay means.

Moreover in the prior art an igniting and ejecting unit centrally arranged in the deployment element is used as activating and distributing means for activating and distributing the IR effective mass and for distributing the RF effective mass.

Herein it may be provided for igniting and ejection to make use of a pyrotechnical charge ignited by an ignition delay means which is ignited by combustion of the ejection propellant charge for the deployment element.

As a pyrotechnical charge, aluminum/potassium perchlorate or magnesium/barium nitrate is generally used.

In the prior art, effective masses annularly arranged around the igniting and ejecting unit are used.

In particular the igniting and ejecting charge is employed in an amount adapted to the number and cross-section of the utilised ejection openings in such a manner that high acceleration forces do not act on the effective masses. Namely, the amount of the igniting and ejecting charge in proportion to the number and cross-section of the ejection openings determines the combustion velocity of the igniting and ejecting charge. At an identical quantity of the charge, the combustion velocity increases concomitantly with a decrease of the overall cross-section of the ejection openings. By selecting a quantity of the igniting and ejecting charge in accordance with the invention, it is ensured that a uniform thrust is exerted on the effective masses, rather than an abrupt impulse corresponding to an explosion.

This does ensure better ignition and distribution of the IR effective masses and a better distribution of the RF effective mass in comparison with conventional explosion principles. However the following problems or drawbacks, respectively, still result:

1. The diameter of the RADAR effective masses on a dipole basis, which are mostly deployed spherically, is sometimes too large to be located entirely inside the range gates of the RADAR target seeking heads.

2. Activation of the RADAR effective masses may take place outside the range gate, making them invisible to the target seeking head and therefore ineffective.
3. The large diameter of the deployed dipole effective masses results in an excessively low dipole density at the outer limits of these prior art effective masses. Density distribution herein corresponds roughly to a Gaussian distribution with a gradually increasing density towards the effective mass center, without the required contouring relative to the background echo.
4. The dipoles of the standard RADAR effective masses assume a horizontal orientation after about 5 seconds and absorb/emit the horizontal component of a radar wave exclusively. Target seeking heads possessing a vertically polarised RADAR are therefore capable of discerning these dipoles.
5. Both the RADAR and IR effective masses are mostly distributed within hard metallic receptacles by means of a detonator charge, resulting in disintegration fragments which may cause considerable damage when the decoy is discharged at minimum range, e.g., of a ship (in the range gate of the target seeking head).

Embarking from the prior art of DE 196 17 701 and corresponding U.S. Pat. No. 5,835,051, it is therefore an object of the present invention to furnish an improved method and an improved decoy avoiding at least one of the above described drawbacks.

SUMMARY OF THE INVENTION

According to one formulation, the invention is directed to a method for offering a phantom target for protecting an object against at least one missile possessing both a first target seeking head operating in the infrared (IR) wavelength range or in the radar (RF) wavelength range and a second target seeking head operating simultaneously or serially with the first target head in both of the wavelength ranges. The method includes: causing an effective mass emitting radiation in the infrared range (IR effective mass) based on flares and an effective mass backscattering radiation in the radar range (RF effective mass) based on dipoles to take effect simultaneously in a given position, as a phantom target. A ratio of dipole mass to flare mass in a range of about 3.4:1 to about 6:1 is employed. The flares present a descent rate about 0.5 to 1.5 m/s higher than a descent rate of the dipoles.

In terms of device technology, the object is attained by means of a combined radar-infrared decoy including a decoy body and dipoles and flares contained in the body in a ratio of about 3.4:1 to about 6.0:1, whereby the flares, following disintegration of the decoy body, present a descent rate which is about 0.5 m/s to about 1.5 m/s higher than the descent rate of the dipoles.

Thus, the invention relates to deployment of a dual mode decoy and to the decoy itself. Dual mode decoys having concurrent RADAR and IR efficiency utilizing combined RADAR/IR effective masses, as well as the associated effective masses, are known from DE 196 17 701 and its corresponding U.S. Pat. No. 5,835,051. Given their relevance to the present application, the full disclosures of these two references are incorporated into the present application by reference.

By employing a ratio of dipole mass to flare mass of approx. 3.4:1 to approx. 6:1 and by using flares that present a descent rate that is approx. 0.5 to 1.5 m/s higher than that of the dipoles, it is achieved that the dipoles are swirled by the thermal upcurrent as a result of combustion of the flares. This avoids an exclusively horizontal orientation of the dipoles and instead produces a statistical orientation, so that, on the whole, the desired RADAR omnipolarity is produced.

The required descent rates of the flares may be adjusted through size and shape of the flares on the one hand, and through the mass per unit area of the flares used, on the other hand.

Geometrical flare shapes which were found to be favorable for the purposes of the present invention include semicircular, quarter-circle and trapezoidal shapes.

The radius for the partially circular flares is preferably approx. 60 to 130 mm. With such flares, the descent rate of the burning flares may be adjusted to approx. 1.5 m/s to 2.5 m/s, so that the flares generating hot exhaust gases present a descent rate which is by approx. 0.5 to 1.5 m/s higher than that of the dipoles.

BRIEF DESCRIPTION OF THE DRAWINGS

Further features and advantages of the invention result from the description of preferred embodiments and by reference to the drawing, wherein.

DESCRIPTION OF THE PREFERRED EMBODIMENTS

Figure 1:
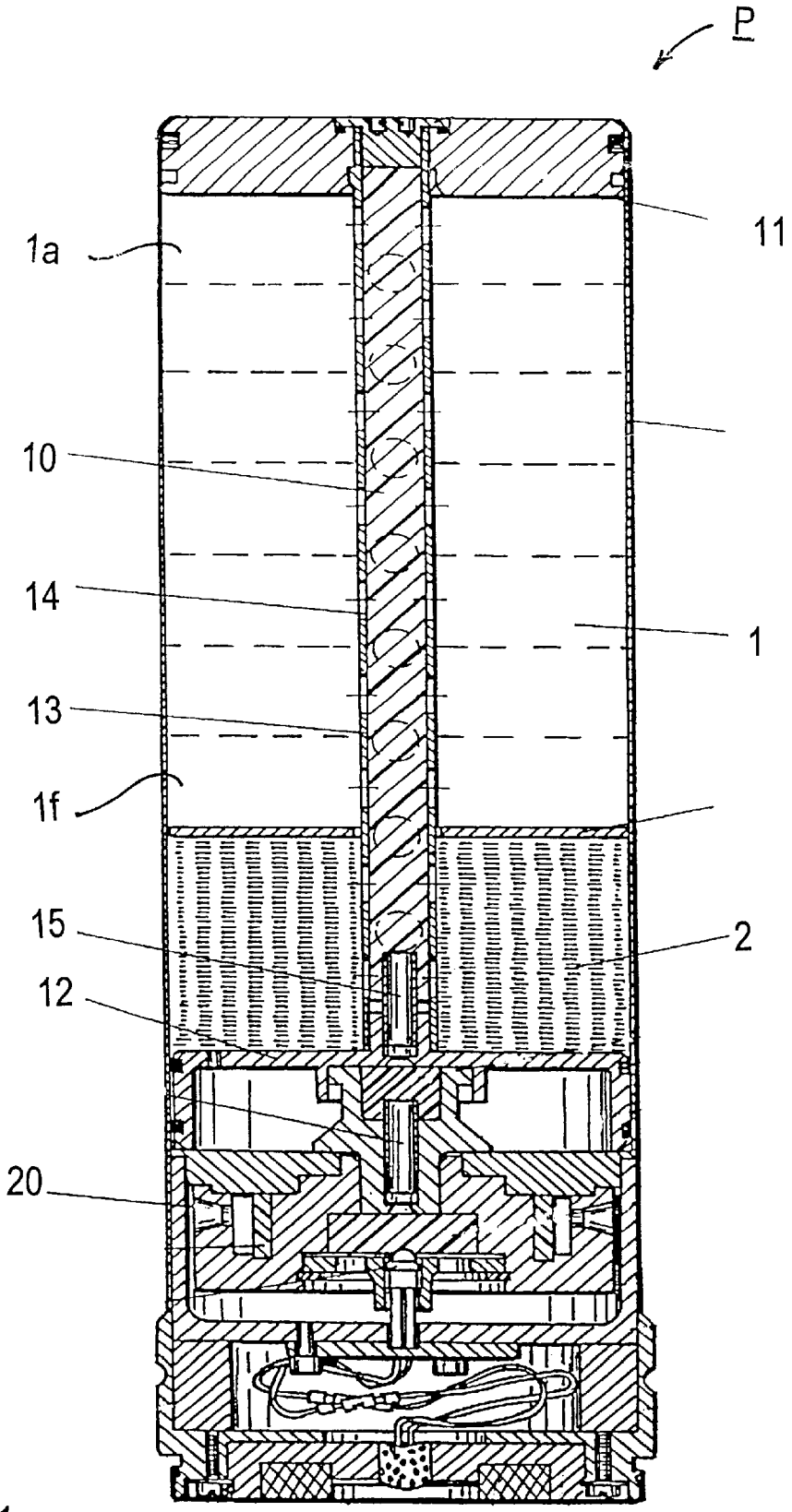
FIG. 1 is a sectional view of an embodiment of a decoy according to the invention.

FIG. 1 illustrates one embodiment of a dual mode decoy having concurrent RADAR and IR capability through the use of RADAR and IR effective masses.

In a preferred embodiment of the present invention, the RADAR/IR effective masses 1, 2 are retained merely by a metallic (so-called) stay 10 without any additional sheath. This metallic stay includes a top disc 11 and a bottom disc 12, preferably of aluminum or steel, and an intermediate disintegrator or ejection tube 13, preferably of steel, and further includes a pyrotechnical ejection charge as mentioned above, so that, during the virtually unscreened ejection process, this metallic stay is preserved, and fragments posing a threat to the object to be protected are not generated. Herein the ejection tube 13 is preferably provided with a plurality of ejection openings 14 over the length and the circumference thereof.

The RADAR/IR effective mass held in the stay is discharged in a plurality of single portions or sub-munitions 1*a*–1*f*, 2 (corresponding to a plurality of stays), preferably 3 to 7 sub-munitions. Following deployment of the projectile P, these sub-munitions preferably have different disintegration or ejection locations in accordance with the mortar or rocket principle, so as to avoid a detrimental shading of the effective masses, by offering a high projected surface to the target seeking head of the incoming missle. Preferably, the sub-munitions are placed in vertical and/or horizontal alignment by way of different ballistics and delay periods, with the clouds having diameters of approx. 10 m to 20 m and presenting a spacing from each other of 10 m to 20 m.

The sub-munitions are preferably—as was already mentioned—discharged in accordance with the mortar or rocket principle by way of adjusting the delay periods in such a manner that the disintegration or ejection process takes place at a distance from the launcher of preferably approx. 10 m to approx. 60 m, such that the effective masses take effect within the reduced range gates of the target seeking heads.

In accordance with particular embodiments of the invention, a spinning movement can be imparted to the projectile by means of a rotation motor 20. In particular, the projectile P can be given a spinning movement by means of a pyrotechnical rotation motor of the type illustrated in FIG. 1. Alternatively, the projectile can be caused to spin by means of appropriate rifling in the projectile cup used to launch the projectile P.

Moreover, a spinning movement can be imparted to the projectile by means of appropriately designed air baffle surfaces (not shown) of the projectile P.

Moreover, the ignition delay 15 can be designed to be ignited not until after ejection of the effective masses 1, 2 from the projectile shell.

In another particular embodiment of the invention, rolled-up radar chaff including dipoles of aluminum or silver coated glass fiber filaments, which have a thickness in the range of approx. 10 $\mu$m to 100 $\mu$m, is used as the RF effective mass 1.

It is preferred to use dipoles having a dipole length that corresponds to half the anticipated radar wavelength $\lambda$ multiplied by the refractive index n of air. In other words, the dipole length is adapated, inter alia, to the radar wavelength $\lambda$ of the anticipated target seeking head.

Preferably the dipoles used number more than $10^6$/kg.

Advantageously, the dipole packages used have an arrangement such that they open immediately upon ejection.

In accordance with another particularly advantageous embodiment, the invention uses dipole packages protected against the ejection heat by at least one heat shield.

In particular, at least one respective sheet, extending through the entire RF effective mass, can be used for each of the heat shields.

Moreover, the sheet used as the respective heat shield is preferably a heat-resistant, elastic sheet.

In accordance with another particular embodiment of the invention, dipole packages each separated from each other by at least one heat-resistant sheet are used as protection against sliding into each other. Moreover, it is possible to use an RF effective mass that is encompassed on its jacket surface by an aluminum sheath.

In addition, the invention allows for the use of an IR effective mass 2 having flares with a medium-wave radiation component (MWIR flares). In particular, the MWIR flares used may be structured and function in accordance with the disclosure of DE-PS 43 27 976 and its corresponding U.S. Pat. No. 5,635,666. Given the relevance of these documents to the present application, the full disclosures of these two references are incorporated into the present application by reference.

Finally, according to another embodiment, an RF effective mass is used in a proportion of more than 50% of the total effective mass. This proportion was found to be particularly advantageous by means of trials.

A part of the invention as a whole thus includes the surprising insight that an effective phantom target, which diverts not only dual mode target seeking heads but also target seeking heads operating only in a wavelength range (IR or RF range, respectively) from a target to be protected, may be provided by concurrently using an IR effective mass and an RF effective mass, which are made to take effect simultaneously and in a same location (co-location). Thus an improved decoy operating in accordance with the method according to the invention makes it possible to divert combined attacks by IR and RF controlled missiles as well as dual mode controlled missiles.

If, in accordance with a particular embodiment of the invention, the projectile is imparted a spinning movement, this results in stabilisation of the projectile in its trajectory on the one hand. In addition, it also ensures effective random orientation and disintegration of the effective masses by the centrifugal force upon arrival at the target location following ejection of the projectile shell.

Figure 2:
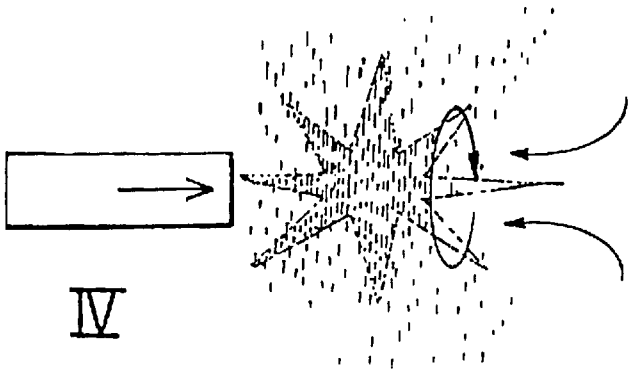
FIG. 2 shows a temporal development of latter in-flight phases of the decoy.
Figure 2:
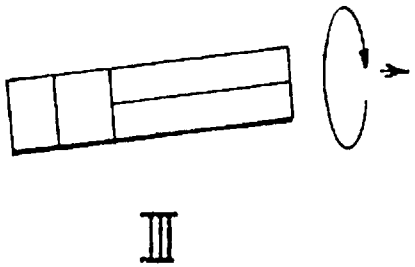
Figure 2:
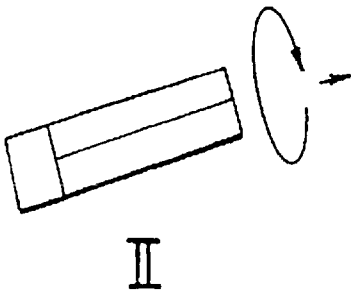

The method according to the invention is now further described, with reference to FIG. 2, by way of a temporal development, from the launch of a decoy to the distribution of the effective masses. The temporal development may be roughly subdivided into four phases: Phase I (not shown): launch of a decoy; Phase II: spin-stabilised in-flight phase of the decoy; Phase III: ejection of the IR and RF effective masses; and Phase IV: activation and distribution of the effective masses.

Figure 3:
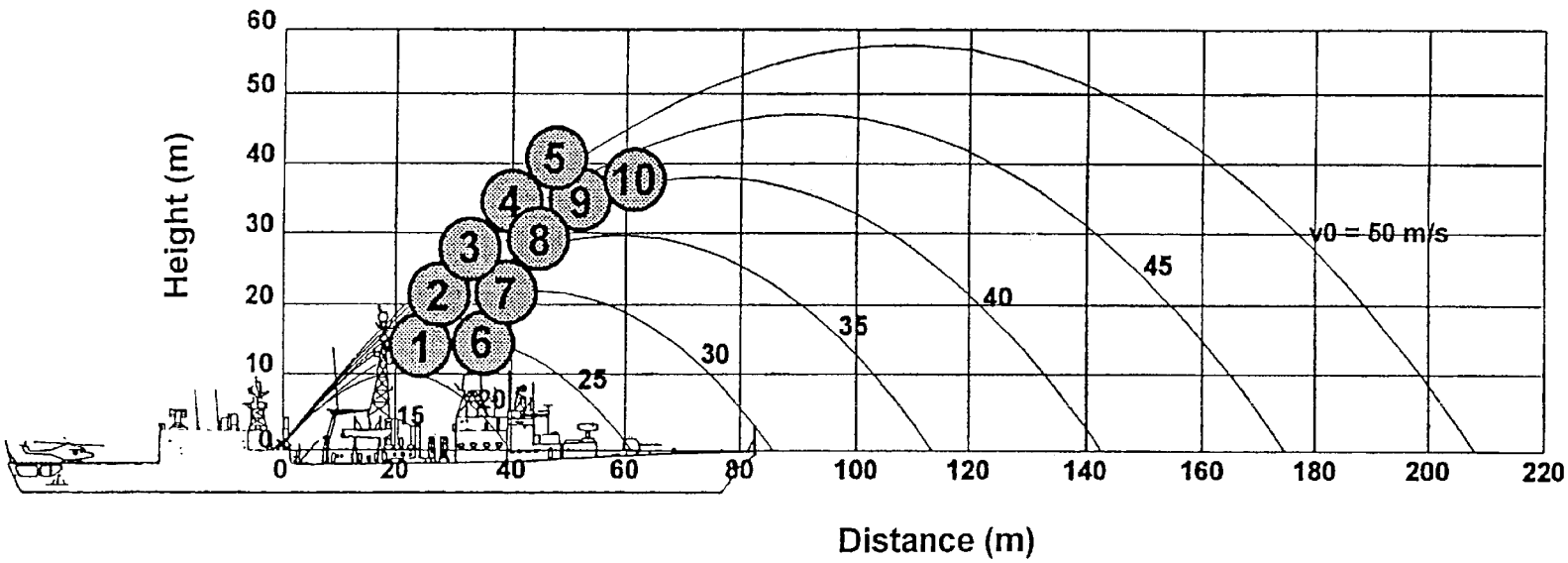
FIG. 3 is a schematic drawing of an exemplary deployment of portions/sub-munitions.

Ignition and launch according to Phase I unfold in conformity with the prior art. In Phase II, the decoy presents a spin-stabilised in-flight phase to thereby achieve defined aerodynamics of the RF and IR effective masses. The momentum of spin is largely preserved until the effective masses are distributed, and is transferred to the effective masses. This in turn brings about an improved distribution of the effective masses. In Phase III, the effective masses, including an activation and distribution mechanism, are ejected from the projectile shell of the decoy during the flight. This results in a subsequent distribution of the effective masses without any screening, with the additional advantage of no excessive pressure acting on the effective masses in distributing of the effective masses. As a result, distribution of the IR effective mass, but in particular distribution of the RF effective mass, is improved considerably. In Phase IV, rotation, aerodynamics, and central ejection are utilized in achieving an effective distribution of the effective masses. FIG. 3 is a schematic representation of Phase IV.

In the present example, quarter-circular (radius=approx. 100 mm) IR flares having a weight per surface unit of approx. 0.4 g/cm$^2$ are used. As RADAR dipoles, aluminum coated glass fiber filaments (approx. $10^6$/kg) are employed. The decoys of the embodiment contain approx. 1.2 kg of dipole mass and about 0.2 kg of flare mass.

Thus one roughly spherical cloud having a diameter of approx. 20 m is generated per sub-munition. The IR flares have a descent rate of approx. 2 m/s and thus descend about 1 m/s faster than the dipoles. Owing to the hot exhaust gases generated by combustion of the flares, the dipoles having a geometrically higher position are entrained and swirled by the thermal upcurrent, whereby a horizontal orientation of the dipoles is prevented. As a result, the dipole characteristics become omnipolar and are thus identified as a target by a dual mode target seeking body.

For the purpose of forming a wall of decoys in the exemplary case of a ship, 10 sub-munitions are deployed via different ballistic curves. This is shown in FIG. 3 where the ordinate indicates the height in meters, and the abscissa indicates the distance, also in meters. A decoy wall height of approx. 45 m and a distance of approx. 65 m are obtained. The horizontal extension of the wall is about 20 m in the example.

The above description of the preferred embodiments has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. A method for offering a phantom target for protecting an object against at least one missile possessing at least one of a first target seeking head operating in the infrared wavelength range or in the radar wavelength range and a second target seeking head operating simultaneously or serially with the first target head in both of the wavelength ranges, comprising:

causing an effective mass emitting radiation in the infrared range based on flares and an effective mass backscattering radiation in the radar range based on dipoles to take effect simultaneously in a given position, as a phantom target;

wherein:

a ratio of dipole mass to flare mass is in a range of about 3.4:1 to about 6.0:1; and the flares present a descent rate about 0.5 to 1.5 m/s higher than a descent rate of the dipoles.

2. The method according to claim 1, wherein the object is a land, air or water vehicle.

3. The method according to claim 1, further comprising:

retaining a total effective mass comprising the infrared effective mass and the radar effective mass with a metallic stay; and discharging the total effective mass in the metallic stay as a plurality of discrete sub-munitions, whereby the sub-munitions have mutually differing disintegration and ejection locations.

4. The method according to claim 3, wherein, in said discharging step:

the sub-munitions are placed in at least one of vertical and horizontal alignment by way of mutually different ballistics and delay periods; and clouds resulting respectively from the sub-munitions have respective diameters of about 10 m to about 20 m and present a respective mutual spacing of about 10 m to about 20 m.

5. The method in accordance with claim 1, further comprising:

imparting a spinning movement to a projectile that houses the effective masses.

6. The method according to claim 5, wherein the spinning movement is imparted by a rifling in a projectile cup launching the projectile.

7. The method according to claim 5, wherein the spinning movement is imparted by air baffle surfaces of the projectile.

8. The method according to claim 1, further comprising:

jointly ejecting the effective masses, together with a deployment element, from a projectile shell; and subsequently activating and deploying the effective masses during an in-flight phase of the projectile by means of the deployment element.

9. The method according to claim 8, wherein an ejection propellant charge is used for said ejecting of the deployment element; and further comprising igniting the ejection propellant charge by an ignition delay, which is ignited by combustion of a propellant charge for the projectile.

10. The method in accordance with claim 8, further comprising:

activating and distributing the infrared effective mass and distributing the radar effective mass by means of an igniting and ejecting unit centrally arranged in a deployment element.

11. The method according to claim 10, wherein the igniting and ejecting unit comprises a pyrotechnical charge; and further comprising:

igniting the pyrotechnical charge by an ignition delay; and igniting the ignition delay by combustion of a propellant charge for the deployment element.

12. The method according to claim 11, further comprising:

burning the pyrotechnical charge of the igniting and ejecting unit inside a tube having a central arrangement in the deployment element and having defined ejection openings.

13. The method according to claim 12, wherein an amount of an igniting and ejecting charge used is adapted to a number and cross-section of bores provided, for preventing high acceleration forces from acting on the effective masses.

14. The method according to claim 11, wherein the ignition delay is ignited subsequently to ejecting the effective masses from a projectile shell.

15. The method according to claim 1, wherein the radar effective mass comprises dipole packages of dipoles of metal-coated glass fiber filaments; and wherein the dipole packages open immediately upon ejection of the effective masses from a projectile shell.

16. A combined radar-infrared decoy comprising:

a decoy body; and dipoles and flares contained in the body, in a ratio of about 3.4:1 to about 6.0:1;

wherein the dipoles have an effective mass for backscattering radiation in a radar range;

wherein the flares have an effective mass for emitting radiation in an infrared range; and wherein the flares, following disintegration of the decoy body, present a descent rate which is about 0.5 m/s to about 1.5 m/s higher than a descent rate of the dipoles.

17. The decoy according to claim 16, wherein the flares have a weight per surface unit in a range of about 0.3 g/cm$^2$ to about 0.5 g/cm$^2$.

18. The decoy according to claim 16, wherein a shape of the flares is selected from at least one of a semicircular shape, a quarter-circular shape and a trapezoidal shape.

19. The decoy according to claim 16, further comprising:

a metallic stay without an outer metal sheath, the metallic stay retaining a total effective mass consisting of the infrared effective mass and the radar effective mass; wherein the stay comprises upper and lower layers of aluminum or steel and an intermediate ejection tube between the upper and lower layers.

20. The decoy according to claim 19, wherein the intermediate ejection tube is centrally axially located and provided with a plurality of ejection openings.

21. The decoy according to claim 19, wherein:

at least the radar effective mass of the total effective mass is retained as a plurality of discrete sub-munitions.

22. The decoy according to claim 21, wherein the plurality of discrete sub-munitions is in a range of 3 to 7 sub-munitions.

23. The decoy according to claim 16, further comprising:

a projectile housing the effective masses; and a rotation motor configured to impart a spinning movement to the projectile during deployment of the decoy.

24. The decoy according to claim 23, wherein the rotation motor is a pyrotechnical rotation motor.

25. The decoy according to claim 23, wherein the projectile has a caliber in a range of about 10 mm to about 155 mm.

26. The decoy according to claim 16, further comprising:

a projectile housing the effective masses;

a deployment element for ejecting the effective masses from the projectile during an in-flight phase of the projectile;

an ejection propellant charge for causing the deployment element to eject the effective masses;

an ignition delay for igniting the ejection propellant charge; and a propellant charge for propelling the projectile and igniting the ignition delay.

27. The decoy according to claim 26, wherein the ignition delay igniting the ejection propellant charge for the deployment element is a pyrotechnical ignition delay.

28. The decoy in accordance with claim 16, further comprising:

a deployment element with an igniting and ejecting unit centrally arranged in the deployment element for activating and distributing the infrared effective mass and distributing the radar effective mass.

29. The decoy according to claim 28, wherein the igniting and ejecting unit comprises a pyrotechnical charge; and further comprising:

an ignition delay for igniting the pyrotechnical charge; and a propellant charge for propelling the deployment element and for igniting the ignition delay by combustion.

30. The decoy according to claim 29, wherein the pyrotechnical charge comprises aluminum/potassium perchlorate or magnesium/barium nitrate.

31. The decoy according to claim 29, wherein the deployment element comprises a centrally arranged tube provided with ejection openings; and wherein the pyrotechnical charge of the igniting and ejecting unit is burned inside the tube.

32. The decoy according to claim 16, further comprising a deployment element for ejecting the effective masses, wherein the effective masses are arranged behind each other and in a longitudinal direction of the deployment element.

33. The decoy according to claim 16, further comprising an igniting and ejecting unit for the effective masses, wherein the effective masses are arranged annularly around the igniting and ejecting unit.

34. The decoy according to claim 16, wherein the radar effective mass comprises rolled-up radar chaff comprising dipoles of aluminum- or silver-coated glass fiber filaments having a thickness in a range of about 10 $\mu$m to about 100 $\mu$m.

35. The decoy according to claim 34, wherein the dipoles have a dipole length l, corresponding to half an anticipated radar wavelength $\lambda$ multiplied by the refractive index n of air.

36. The decoy according to claim 34, wherein the dipoles number greater than $1\times10^6$/kg.

37. The method according to claim 34, wherein dipole packages of the dipoles are protected against ejection heat by at least one heat shield.

38. The decoy according to claim 37, wherein the heat shield comprises at least one sheet that extends through the entire radar effective mass.

39. The decoy according to claim 38, wherein the sheet is a heat-resistant, elastic sheet.

40. The decoy according to claim 37, wherein the heat shield comprises at least one heat resistant sheet, and wherein the dipole packages are separated from each other by at least the one heat-resistant sheet that protects the dipole packages from sliding into each other.

41. The decoy according to claim 16, wherein the radar effective mass comprises a jacket surface, and wherein the radar effective mass is encompassed at the jacket surface by an aluminum sheath.

42. The decoy according to claim 16, wherein the radar effective mass includes flares having a medium-wave radiation component.

43. The decoy according to claim 42, wherein the flares have a flare mass comprising an incendiary composition component and an inert component, and wherein the incendiary composition component and the inert component are mixed in a weight ratio such that ignition of the flare mass produces a spectral radiant flux distribution substantially matched to a spectral radiant flux distribution of an object to be mimicked by the decoy.

* * * * *